United States Patent [19]

Blore

[11] 4,199,633

[45] Apr. 22, 1980

[54] NAPPED DOUBLE KNIT FABRIC AND METHOD OF MAKING

[75] Inventor: James H. Blore, Greenville, S.C.

[73] Assignee: Phillips Petroleum Company, Bartlesville, Okla.

[21] Appl. No.: 906,532

[22] Filed: May 16, 1978

[51] Int. Cl.[2] ..... D06C 11/00; B32B 33/00; B32B 7/00; D03D 9/00

[52] U.S. Cl. ..... 428/91; 428/255; 28/162; 66/202

[58] Field of Search ..... 66/194, 196, 198, 202, 66/17, 19, 22, 38; 28/162; 26/29 R; 428/91, 89, 255

[56] References Cited

U.S. PATENT DOCUMENTS

| | | | |
|---|---|---|---|
| 2,338,792 | 1/1944 | Whitehead | 26/1 |
| 2,575,008 | 11/1951 | Dorgin | 28/76 |
| 2,639,488 | 5/1953 | Stanley et al. | 28/76 |
| 2,789,340 | 4/1955 | Cresswell | 28/76 |
| 2,810,281 | 10/1957 | Appleton et al. | 66/202 |
| 3,085,410 | 4/1963 | Loizillon | 66/198 X |
| 3,305,911 | 2/1967 | Chapman et al. | 28/72 |
| 3,327,501 | 6/1967 | Bahlo | 66/192 |
| 3,532,529 | 10/1970 | Endo et al. | 428/91 X |
| 4,019,350 | 4/1977 | Schmidt | 66/196 |
| 4,079,602 | 3/1978 | Blore | 66/202 X |

*Primary Examiner*—Ronald Feldbaum

[57] ABSTRACT

A double knit fabric includes a plurality of courses knitted to form first and second sets of alternating wales. The first set of alternating wales forms the face of the fabric while the second set of alternating wales forms the reverse side of the fabric. The courses are knitted in a preselected pattern to form stitches which join the courses together at selected wales. First yarns are used to form selected courses with the first yarns having a higher shrinkability than second yarns forming the remainder of the courses. Selected second yarns are knit in a pattern which allows portions of the second yarns to float on the face of the fabric. The floating portions are formed by causing the yarn to welt or miss at least two consecutive wales of the first set of alternating wales. When at least the first yarns of the thus knitted fabric are subjected to shrinking treatment the first yarns shrink more than the second yarns thereby causing the floating portions of the second yarns to project from the fabric for subsequent napping. Napping of the thus shrink-treated fabric causes the floating portions to be fractured and thereby produce nap on the face of the fabric.

17 Claims, 7 Drawing Figures

8
7
6
5
4
3
2
1
D C D C D C

STITCH PATTERN

NAPPED DOUBLE KNIT FABRIC AND METHOD OF MAKING

The present invention relates to a napped double knit fabric and a method of making said fabric, as well as a double knit fabric from which the napped fabric can be made.

Double knit fabrics have become widely used in the textile industry for clothing. Most of the double knit fabrics used for clothing are made from polyester yarns and have gained wide acceptance commercially. There is demand in the clothing industry for napped fabrics made from a relatively rigid double knit material. Napped double knit fabrics are particularly desirable for use in coats and jackets because of their appearance and the advantages attendant with using double knit fabrics. Double knit fabrics are highly desirable types of fabrics because of their appearance, weight, softness and ease of maintenance. There are many napped fabrics known in the art; however, napped double knit fabrics are difficult to make because the smooth surface of the double knit fabric makes it difficult for the nap brush to dig into the fabric and raise and/or fracture the napping yarns in the fabric.

The present invention overcomes the above difficulties and provides a method of producing double knit fabrics which can be easily napped and which will provide a somewhat rigid material underlying the napped surface. Further, the present invention provides a double knit fabric which can be easily napped and provides a method of making double knit fabric which can be made with conventional fabric producing machines and techniques.

It is an object of the present invention to produce a napped double knit fabric. It is another object of the present invention to provide a method of producing a napped double knit fabric which can be made using conventional techniques. It is a further object of the present invention to provide a double knit fabric which is adapted for forming a napped double knit fabric. It is a still further object of the present invention to provide a napped double knit fabric and a method of producing the napped double knit fabric which are well adapted for their intended use.

Other objects and advantages of the present invention will become apparent from the following detailed description taken in connection with the accompanying drawings wherein are set forth by way of illustration and example certain embodiments of this invention.

Figure 1:
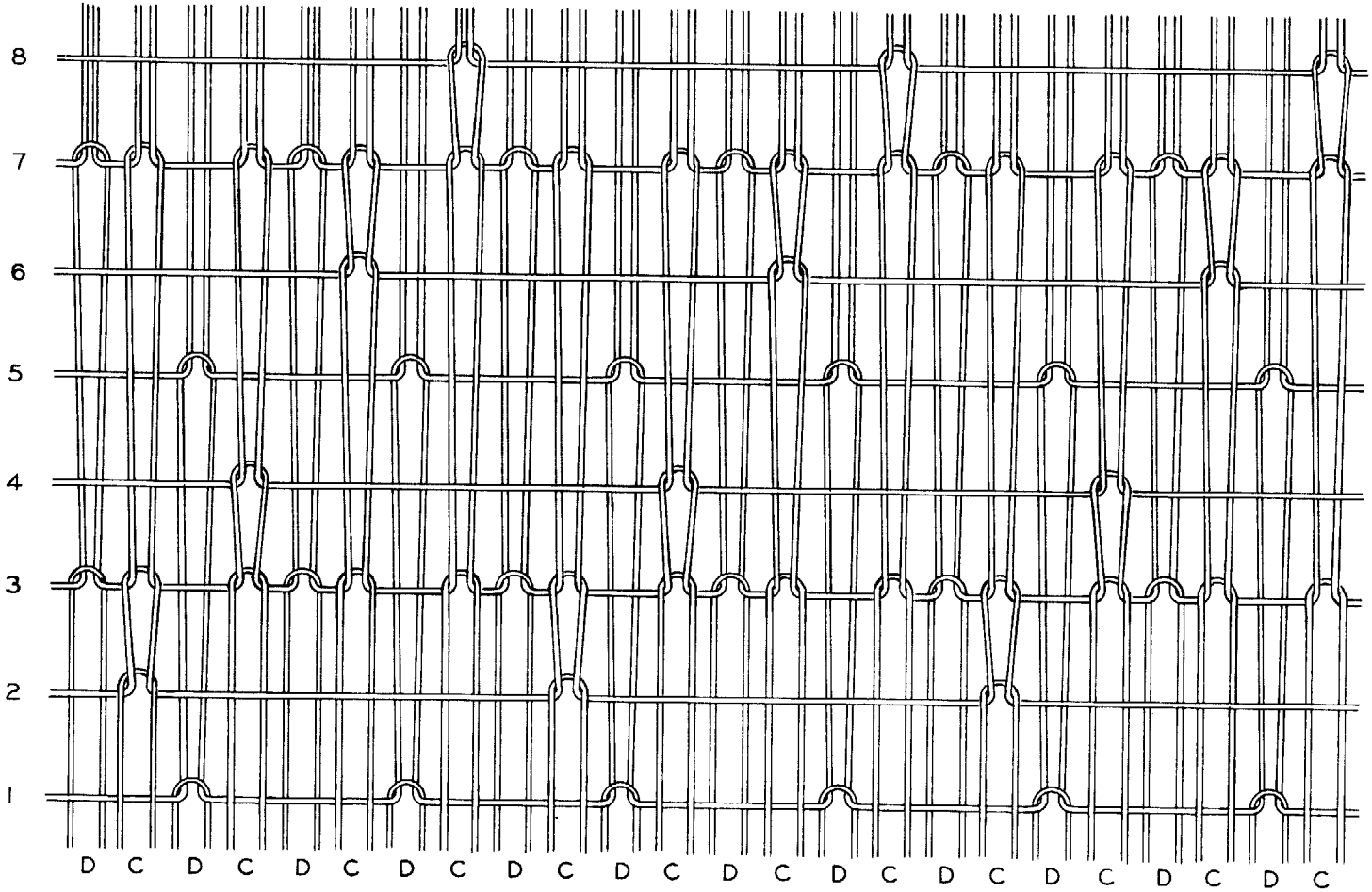
FIG. 1 is a plan view showing the front face of the knitted fabric with the knitted fabric being expanded for clarity.

FIG. 1 illustrates a fabric swatch eight courses high and 24 wales wide. This can constitute the complete repeat pattern for the fabric or only a portion of the repeat pattern. As illustrated, the swatch is a complete repeat pattern. Any suitable stitch pattern can be used for the face and reverse side of the fabric within the repeat pattern consistent with the below described objects and limitations. The fabric is comprised of alternating sets of wales which include a first set of alternating wales and a second set of alternating wales. The first set of wales $C_1, C_2 \ldots C_{12}$ is formed by the cylinder needles while the second set of wales $D_1, D_2 \ldots D_{12}$ is formed by dial needles. The first set of wales forms the front face of the fabric while the second set of wales forms the reverse or back face of the fabric. Thus each cylinder wale in the interior of the fabric is positioned between the two adjacent dual wales. Such a fabric can be made on any suitable double knit knitting machine as is known in the art such as a Wildt Mellor Bromley Ltd. circular double machine, type 8/RJ having a thirty inch diameter cylinder, and employing 18 dial needles to the inch and 18 cylinder needles to the inch. In the finished fabric, the set of cylinder wales is in a plane parallel to the set of dial wales and the fabric contracts laterally so that the cylinder wales contact each other to form the face of the fabric and the dial wales contact each other to form the reverse side of the fabric.

The courses 1,2 . . . 8 are each formed by respective yarns. Each course can be formed from a respective single yarn or from a respective plurality of yarns, with all of the courses having the same number of yarns, or some of the courses can be formed from one or more yarns and other courses can be formed from a different number of yarns. The yarns forming the courses can be monofilament or multifilament, with multifilament yarns being preferred. The yarns can also be textured or non-textured as more fully described hereinbelow. The courses in the fabrics shown in FIG. 1 are an eight repeat pattern and are knitted in the weft direction whereby the stitches extend in the wale direction. The stitches tie the courses together to form an integral fabric. The stitch lengths can vary for each of the yarns and can be set in a preselected pattern. The courses are constructed from at least two different types of yarns, one type forming a first set of courses (yarns 1 and 5) and a second type forming a second set of courses (yarns 2, 3, 4, 6, 7 and 8). The first set of courses is constructed from yarns which preferably have high shrinkability such as textured yarns or partially oriented non-textured yarns. The second set of courses is constructed from yarns which preferably have substantially no or low shrinkability relative to the shrinkability of the yarns of the first set of courses. The yarns in the second set of courses are also preferably textured and heat set to have relatively low shrinkability. At least one course of the first set of courses is followed by at least one second set of courses. Preferably, each course of the first set is spaced apart at least two courses, i.e., at least one course of the second set is between any two courses of the first set and preferably from two courses to about eight courses of the second set are between an adjacent pair of courses of the first set. The second set of courses will usually make up the remainder of the fabric. Preferably, the knit stitches in the first set of courses are only on the dial needles.

Preferably, the knit stitches in selected courses of the second set of courses (e.g., courses 2, 4, 6 and 8 in the illustrated fabric) are formed only on cylinder needles, with portions of the respective yarns between knit stitches floating on the face of the fabric with the length of the floating portions being at least two cylinder wales (or at least three dial and two cylinder wales) between knit stitches and preferably in the range of about two to about ten cylinder wales. The remainder of the courses (e.g., 3 and 7) of the second set are preferably spaced apart four courses and knit on both the dial and cylinder needles to tie the first and second sets of wales together. It is preferred that the floating portions be about four cylinder wales in length between knit stitches and the courses containing floating portions be spaced apart at least two courses and preferably from about two courses to about eight courses. The floating portions are subsequently fractured or broken during napping to form the nap. The amount of napping desired will determine the length of the floating portions to be used.

The above described fabric is suitably knitted on a knitting machine to form a fabric similar to that shown in an expanded condition in FIG. 1. The yarns of the first set of courses have a shrinkability sufficiently higher than the yarns of the second set of courses to effect sufficient puckering or raising of a portion of the second set of yarns from the fabrics after heat treating to be fractured by napping means. The fabric after knitting is subjected to a heat treatment to effect shrinking of the yarns of the first set of courses relative to the floating yarns of the second set of courses to a degree such that the floating portions of the yarns of the second set of courses pucker or are raised to be engageable by napping means. The shrinking is preferably accomplished by contacting the fabric after knitting with hot water as for example 212° F. or 100° C. water for about 10 minutes to effect the shrinking of at least the yarns of the first set of courses relative to the yarns having the floating portion of the second set of courses. However, it is to be noted that any suitable type of heat treatment to effect shrinking can be used as long as the first set of yarns shrink relative to at least the yarns having floating portions of the second set of courses. Preferably, all the yarns of the second set of courses are similar in shrinkability. For example, the fabric can be treated in an oven in a temperature range of 212°-350° F. (100°-176° C.). The yarns of the first set of courses will generally have a shrinkability in the range of about 20% to about 90%, preferably in the range of about 40% to about 90%, per ASTM D 2279-71. The yarns of the second set of courses can have a shrinkability in the range of 0% up to about 80%, preferably in the range of 0% up to about 50%, of the shrinkability of the yarns of the first set of courses.

After the shrinking process has been accomplished, the thus treated fabric is subjected to a napping process. Any suitable type of napping process can be employed. However, a preferred embodiment is the use of a wire napping roll as known in the art. The fabric after shrink treatment is contacted by the napping roll which preferentially engages the floating portions of the yarns of the second set of courses to fracture or break at least part of the floating portions. The fracturing of the floating portions produces the nap which is the fractured filaments of the floating portions on the front face of the fabric. The amount of nap will be determined by the particular yarns used to form the floating portions and the length of the floating portions. A more dense nap can be produced by using floating portion yarns having more filaments and/or a longer nap can be obtained by increasing the length of the floating portions.

Figure 4:
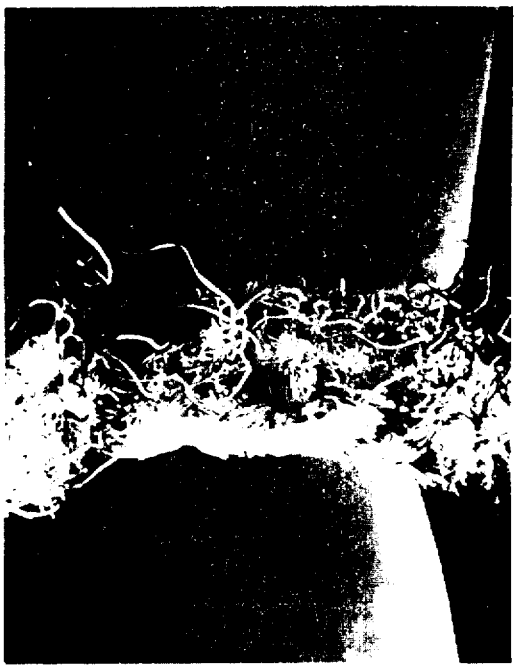
FIG. 4 is a photographic reproduction of the double knit napped fabric shown in side-elevational view magnified about 20×.
Figure 5:
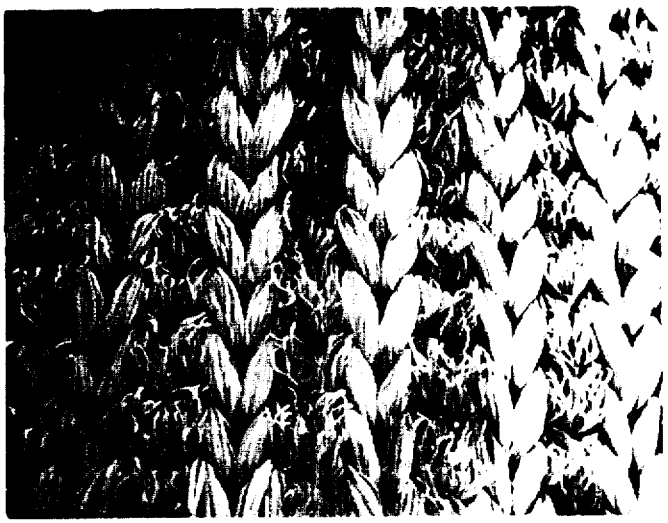
FIG. 5 is a photographic reproduction of the reverse side of the fabric after napping magnified about 20×.
Figure 6:
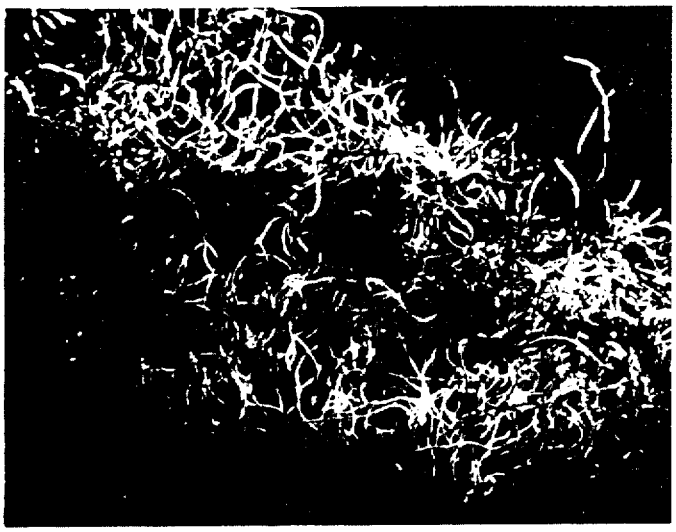
FIG. 6 is a photographic reproduction of the front face of the fabric of FIG. 5 magnified about 20×.
Figure 7:
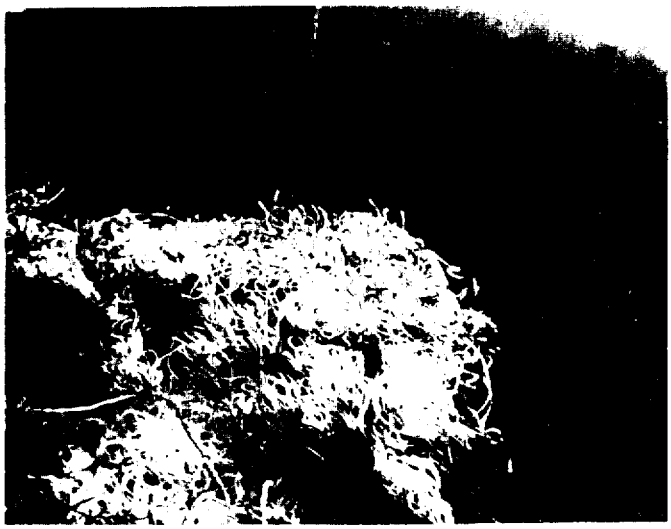
FIG. 7 is a photographic reproduction of an unnapped portion of the front face of the fabric after shrinking magnified about 20×.

As seen in FIG. 6, the top or front surface has been napped, illustrating the amount of napping which can be achieved by employing the above knitting and treating process. FIG. 4 is an edge view of the fabric illustrating the degree of napping which can be achieved by the present invention. FIG. 5 shows the reverse side face of the fabric, while FIG. 7 shows an unnapped portion of the front face of the fabric illustrating the appearance of the front face of the fabric before napping.

The fabric preferably is made of yarns which are of synthetic fibers which can be either staple fibers or continuous filaments. Preferred synthetic materials for the yarns are polyester, nylon, polyolefins, polyacrylates and the like. Although the invention has been described with the yarns of the first set of courses being partially oriented, non-textured yarns and the yarns of the second set of courses being textured heat set yarns, either or both yarns could be textured or non-textured. The important requirement is that the yarns of the first set of courses have a higher shrinkability than the yarns of the second set of courses having floating portions to enhance the puckering of the floating portions for napping. Those courses of the second set of yarns that tie the fabric together by knitting on both the cylinder and dial needles can have a minor different shrinkage factor from the yarns with floating portions, for example, generally up to about 10%, without affecting the appearance of the fabric. The denier of the yarns of the first set of courses can be as high as about 300 denier or about 9 dpf while the denier of the yarns of the second set of courses can be as high as about 150 denier or about 5 dpf.

Figure 2:
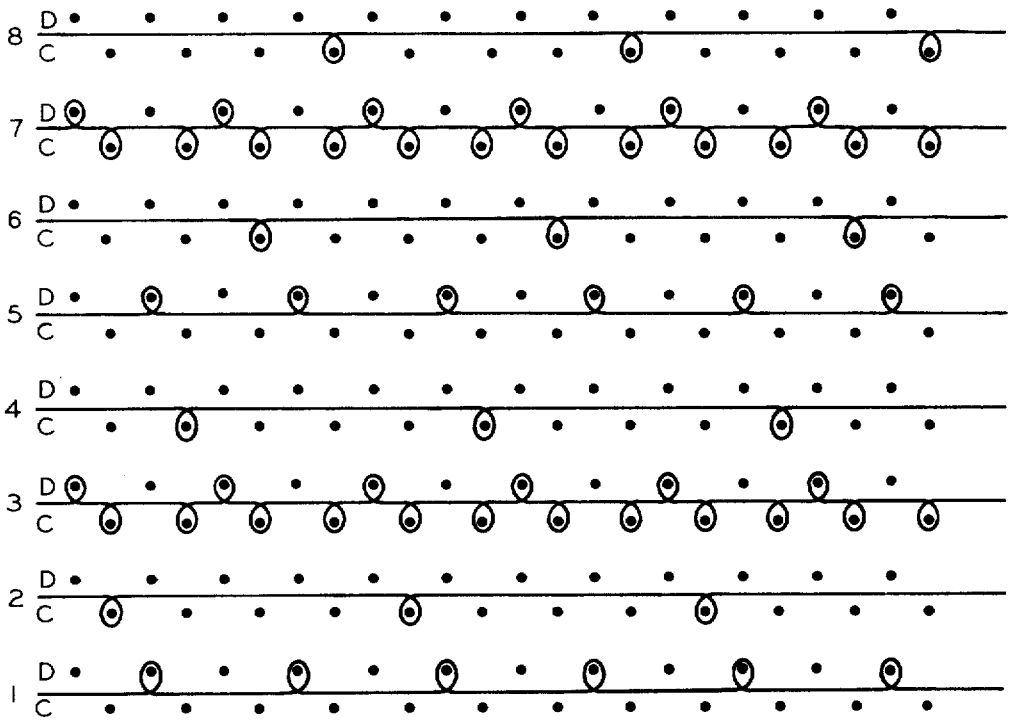
FIG. 2 is a stitch pattern of the fabric illustrated in FIG. 1.
Figure 3:
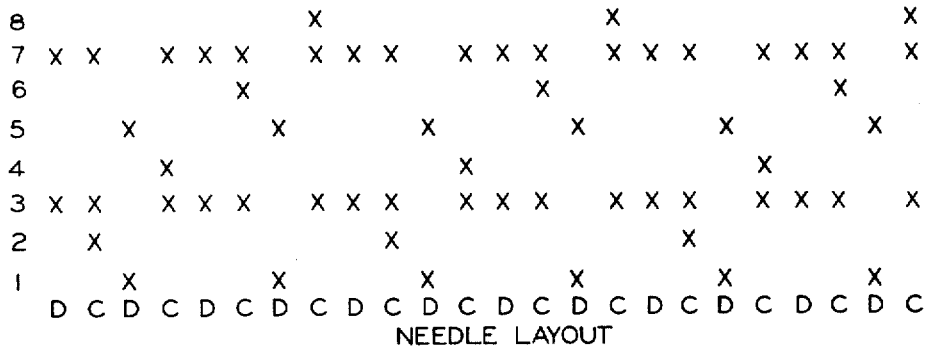
FIG. 3 is a pattern diagram of the face stitches formed by the cylinder needles and the reverse side stitches formed by the dial needles in making the portion of the fabric illustrated in FIG. 1.

Now referring to FIGS. 1, 2, and 3, a suitable pattern for a fabric which meets the requirements of the invention is illustrated. The pattern is an eight course repeat pattern. The yarns of the first set of courses, having high shrinkability, are knitted on courses 1 and 5. Both of these courses miss the first dial needle and then knit on every other dial needle only, no cylinder needles knit. The yarns of the second set of courses having floating portions are knitted on courses 2, 4, 6, and 8 on the cylinder needles only, no dial needles knit. Course 2 is knitted by the first cylinder needle and the yarn then floats on the front of the fabric for the next three cylinder wales and the course 2 is then knitted by the fifth cylinder needle, ninth cylinder needle and continues being knitted in this sequence. Course 4 is knitted by the second cylinder needle and the yarn then floats on the front of the fabric, and is then knitted by the sixth cylinder needle, tenth cylinder needle and continues being knitted in this sequence. Course 8 is knitted by the third cylinder needle then floats on the front of the fabric, and is then knitted by the seventh cylinder needle, eleventh cylinder needle and continues the sequence. Course 8 is knitted by the fourth cylinder needle and floats on the front of the fabric, and is then knitted by the eighth cylinder needle, twelfth cylinder needle and continues the sequence. Courses 3 and 7 of the second set of courses are knitted on both the dial and cylinder needles to tie the fabric together by knitting both the first dial and cylinder needles and from then on knitting on all cylinder needles and every other dial needle.

In a specific example, a fabric was made with the knitting pattern described above and shown in FIGS. 1-3, using a non-textured partially oriented polyester 250/34 yarn for the first set of courses or yarns in courses 1 and 5 and a textured heat set polyester 100/34 yarn for the second set of yarns in courses 2, 3, 4, 6, 7, and 8. The fabric was made on a Wildt Mellor 18 cut circular doubleknit machine. The fabric when taken from the machine and cut was 60 inches wide. The fabric was then heat treated in boiling water for 10 minutes to effect shrinkage. After the heat treatment, the fabric was 38 inches wide and was framed to 45 inches wide for stability. The floating yarns were napped, using a wire napping wheel producing a napped fabric weighing about 15 ounces per square yard.

It is to be understood that while there has been illustrated and described certain forms of this invention, it is not to be limited to the specific form or arrangement of parts herein described and shown except to the extent that such limitations or their equivalents are found in the claims.

What is claimed and desired to be secured by Letters Patent is:

1. A method of making a napped double knit fabric having first and second sets of alternating wales, said first set of alternating wales forming the face of said fabric and said second set of alternating wales forming the reverse side of said fabric, which method comprises knitting a plurality of courses with each said course including at least one yarn, said courses being knitted in a preselected pattern to join said courses together at selected wales, selected ones of said plurality of courses being formed with second yarns having a lower shrinkability than first yarns forming at least a portion of the remainder of the courses, at least one of said selected courses containing a second yarn being followed by at least one course containing a first yarn and having portions of the second yarns floating on one face of the fabric with the length of the floating portions being at least two wales of the first set of alternating wales between stitches;

shrinking said first yarns relative to said second yarns; and napping the floating portions on the face of said fabric to break said floating ortions and thereby produce nap.

2. A method as set forth in claim 1 wherein:

said first yarns are shrunk before napping between about 20 percent and about 90 percent in length and said second yarns are shrunk in length between 0 percent and about 80 percent of the amount the first yarns are shrunk during said shrinking.

3. A method as set forth in claim 2 wherein:

said second yarns are multifilament yarns.

4. A method as set forth in claim 3 wherein:

said first yarns are comprised of partially oriented filaments; and said second yarns are textured and heat set multifilament yarns.

5. A method as set forth in claim 2 wherein:

the length of each of the floating portions of the second yarns is in the range of about 2 wales of the first set of alternating wales to about 10 wales of the first set of alternating wales and said selected courses of second yarns having floating portions are spaced apart between about 2 courses and about 8 courses.

6. A napped double knit fabric made in accordance with a method as set forth in claim 1.

7. A double knit fabric having first and second sets of alternating wales, said first set of alternating wales forming the face of said fabric and said second set of alternating wales forming the reverse side of said fabric, said fabric including:

a plurality of courses with each said course including at least one yarn, said courses being knitted in a preselected pattern to form stitches which join said courses together at selected wales, a plurality of first yarns forming a plurality of first courses and a plurality of second yarns forming a plurality of second courses, said second yarns having a lower shrinkability than said first yarns, at least one of selected ones of said second courses being followed by at least one of selected ones of said first courses, said second yarns forming said selected courses having portions thereof floating on the one face of the fabric with the length of the floating portions being at least two wales of the first set of alternating wales between knit stitches.

8. A fabric as set forth in claim 7 wherein:

said first yarns have a shrinkability of between about 20 percent and about 90 percent in length and said second yarns having a shrinkability in length of 0 percent up to about 80 percent of the shrinkability of the first yarns.

9. A fabric as set forth in claim 8 wherein:

said second yarns are multifilament yarns.

10. A fabric as set forth in claim 9 wherein:

said first yarns are comprised of partially oriented fibers; and said second yarns are multifilament, textured and heat set yarns.

11. A fabric as set forth in claim 8 wherein:

said length of the floating portions of the second yarns is between about 2 wales of the first set of alternating wales and about 10 wales of the first set of alternating wales and said selected courses of second yarns are spaced apart between about 2 courses and about 8 courses.

12. A fabric as set forth in claim 7 wherein:

said fabric has been subjected to heat sufficient to effect shrinking of at least said first yarns.

13. A napped double knit fabric made by napping a double knit fabric of claim 7.

14. A napped double knit fabric having first and second sets of alternating wales, said first set of alternating wales forming the face of said fabric and said second set of alternating wales forming the reverse side of said fabric, said fabric including:

a plurality of courses with each said course including at least one yarn, said courses being knitted in a preselected pattern and said courses joined together at selected wales, a plurality of first yarns forming a plurality of first courses and a plurality of second yarns forming a plurality of second courses, said first yarns having been shrunk more than said second yarns after said fabric was knitted, at least one said first course is followed by at least one said second course and nap on the front face formed by said second yarns having portions thereof floating on the front face of the fabric broken with the length of the floating portions being at least two wales of the first set of alternating wales between knit stitches.

15. A fabric as set forth in claim 13 wherein:

said second yarns are multifilament yarns.

16. A fabric as set forth in claim 14 wherein:

said first yarns are comprised of partially oriented fibers; and said second yarns are multifilament, textured, and heat set yarns.

17. A fabric as set forth in claim 13 wherein:

said length of the floating portions of the second yarns is between about 2 wales of the first set of alternating wales and about 10 wales of the first set of alternating wales and said second courses of second yarns are spaced apart between about 2 courses and about 8 courses.

* * * * *